US009644639B2

(12) United States Patent
Duong et al.

(10) Patent No.: US 9,644,639 B2
(45) Date of Patent: May 9, 2017

(54) SHROUD TREATMENT FOR A CENTRIFUGAL COMPRESSOR

(71) Applicant: PRATT & WHITNEY CANADA CORP., Longueuil (CA)

(72) Inventors: Hien Duong, Mississauga (CA); Vijay Kandasamy, Tamil Nadu (IN)

(73) Assignee: PRATT & WHITNEY CANADA CORP., Longueuil (CA)

( * ) Notice: Subject to any disclaimer, the term of this patent is extended or adjusted under 35 U.S.C. 154(b) by 571 days.

(21) Appl. No.: 14/164,494

(22) Filed: Jan. 27, 2014

(65) Prior Publication Data

US 2015/0211545 A1 Jul. 30, 2015

(51) Int. Cl.

| | |
|---|---|
| ***F04D 29/44*** | (2006.01) |
| ***F04D 29/42*** | (2006.01) |
| ***F04D 29/68*** | (2006.01) |
| ***F04D 17/10*** | (2006.01) |
| ***F04D 23/00*** | (2006.01) |

(52) U.S. Cl.

CPC ..... *F04D 29/441* (2013.01); *F04D 17/10* (2013.01); *F04D 23/008* (2013.01); *F04D 29/4206* (2013.01); *F04D 29/685* (2013.01)

(58) Field of Classification Search

CPC ..... F04D 17/10; F04D 23/00; F04D 23/008; F04D 29/44; F04D 29/441; F04D 29/685; F04D 29/4206; F04D 29/403; F04D 29/668; F04D 29/2255; F04D 29/2272; F04D 27/0207; F04D 27/02; F05D 2250/52

USPC ..... 415/58.4

See application file for complete search history.

(56) References Cited

U.S. PATENT DOCUMENTS

| | | | | |
|---|---|---|---|---|
| 3,893,787 | A * | 7/1975 | Jones | F04D 29/685 415/173.5 |
| 4,063,848 | A * | 12/1977 | Wiggins | F04D 27/02 415/172.1 |
| 4,466,772 | A * | 8/1984 | Okapuu | F01D 11/08 415/171.1 |
| 5,333,990 | A * | 8/1994 | Foerster | F04D 29/4213 415/58.4 |
| 5,466,118 | A | 11/1995 | Heinrich | |
| 5,707,206 | A * | 1/1998 | Goto | F01D 11/10 415/173.1 |
| 6,231,301 | B1 * | 5/2001 | Barnett | F04D 27/02 415/119 |
| 6,582,189 | B2 * | 6/2003 | Irie | F01D 5/145 415/119 |

(Continued)

FOREIGN PATENT DOCUMENTS

| | | |
|---|---|---|
| EP | 0754864 | 1/1997 |
| EP | 1008758 | 6/2000 |

*Primary Examiner* — Ninh H Nguyen
*Assistant Examiner* — Aaron R Eastman
(74) *Attorney, Agent, or Firm* — Norton Rose Fulbright Canada LLP

(57) ABSTRACT

The centrifugal compressor described includes an impeller shroud which encloses the impeller and has a curved shroud surface that extends between an inducer portion and an exducer portion. The compressor includes one or more circumferential grooves in the shroud body within the exducer portion. Each groove has opposed wall segments spaced apart therefrom. The wall segments are inclined at a nonzero groove angle relative to a normal of the shroud surface in a direction opposite the fluid flow path along the shroud surface.

19 Claims, 8 Drawing Sheets

(56) References Cited

U.S. PATENT DOCUMENTS

| | | | | |
|---|---|---|---|---|
| 7,025,557 | B2 * | 4/2006 | Japikse | F01D 5/143 415/1 |
| 7,338,251 | B2 * | 3/2008 | Ro | F04D 29/162 415/173.1 |
| 8,337,146 | B2 * | 12/2012 | Yu | F01D 11/122 415/119 |
| 8,550,775 | B2 * | 10/2013 | Chen | F04D 29/162 415/119 |
| 2008/0044273 | A1 * | 2/2008 | Khalid | F04D 29/164 415/57.4 |
| 2009/0041576 | A1 * | 2/2009 | Guemmer | F04D 29/685 415/149.4 |
| 2010/0014956 | A1 | 1/2010 | Guemmer | |
| 2014/0020975 | A1 * | 1/2014 | Konig | F01D 1/06 181/213 |

* cited by examiner

SHROUD TREATMENT FOR A CENTRIFUGAL COMPRESSOR

TECHNICAL FIELD

The present invention relates generally to centrifugal compressors, and more particularly, to a shroud treatment for a centrifugal compressor and a corresponding method.

BACKGROUND

Centrifugal compressors designed for aerospace applications are required to operate over a wide range of flow, speed and power conditions. The acceleration rates required to go from a low to a high power engine state are significant, and as a result, compressors used in aero gas turbine engines require a significant surge margin. This is particularly true for turboshaft engines. In some high power operating conditions, the flow through the inlet of the compressor can become choked, while stalling can occur in a downstream diffuser. As the airflow approaches the impeller exit, known as the "exducer", the separated airflow can form a large vortex creating flow blockage areas with high pressure losses. Large flow blockages can imposes high incidence on the diffuser, and reduce engine stall margin at high compressor speeds.

Accordingly, there exists a need for an improved centrifugal compressor.

SUMMARY

There is provided a centrifugal compressor, comprising: an impeller mounted to a shaft and rotatable about a shaft axis, the impeller having a plurality of impeller vanes; and an impeller shroud enclosing the impeller, the impeller shroud having a shroud surface having inducer and exducer portions, the shroud surface surrounding and radially spaced apart from the impeller vanes to define a fluid flow path between the shroud surface and the impeller vanes, at least one groove defined by opposed wall segments which extend into the shroud surface and are inclined at a nonzero angle relative to a normal of the shroud surface at the at least one groove in a direction opposite the fluid flow path along the shroud surface There is also provided a method of improving aerodynamic performance of a centrifugal compressor by reducing flow blockage of a compressible fluid at an exit of an impeller of the centrifugal compressor, the compressor having an impeller shroud enclosing the impeller so as to define a fluid flow path between a curved shroud surface and the impeller, the fluid flow path extending between an inducer portion and an exducer portion of the shroud surface, the method comprising: conveying the compressible fluid substantially parallel to the shaft axis along the fluid flow path through the inducer portion of the centrifugal compressor; conveying the compressible fluid radially away from the shaft axis along the fluid flow path through the exducer portion; and recirculating the compressible fluid between the fluid flow path and at least one circumferential groove extending into a body of the shroud surface within the exducer portion, the at least one groove defined by opposed wall segments which extend into the shroud surface and are inclined at a nonzero angle relative to a normal of the shroud surface in a direction opposite the fluid flow path along the shroud surface.

BRIEF DESCRIPTION OF THE DRAWINGS

Reference is now made to the accompanying figures in which.

DETAILED DESCRIPTION

Figure 1:
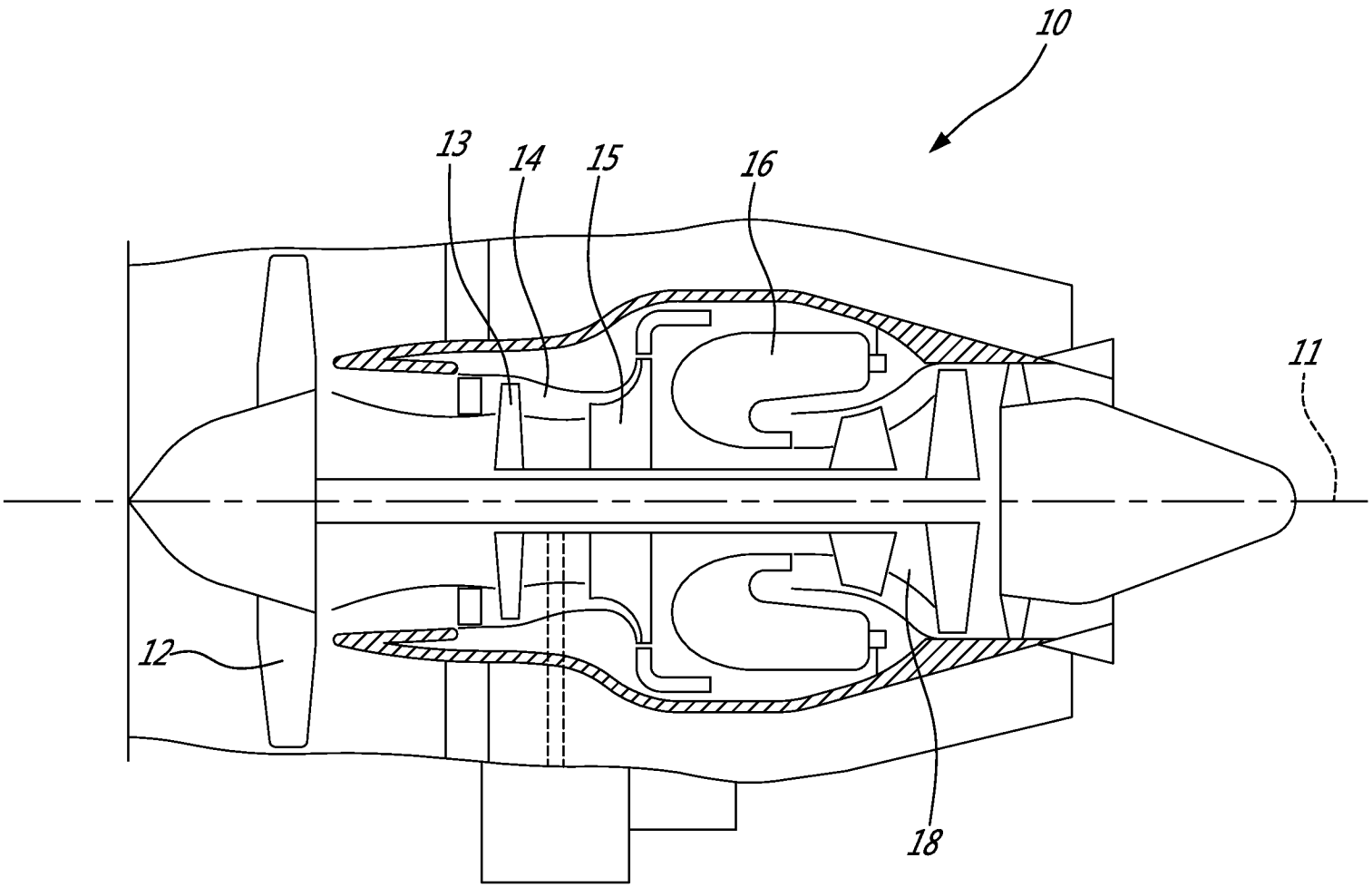
FIG. 1 is a schematic cross-sectional view of a gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air having an axial low pressure compressor (LPC) 13 and a centrifugal high pressure compressor (HPC) 15, a combustor 16 in which the compressed air is mixed with fuel and ignited for generating an annular stream of hot combustion gases, and a turbine section 18 for extracting energy from the combustion gases. The center axis 11 of the engine 10 is also illustrated.

Of particular interest in the present disclosure is the centrifugal HPC 15, although it is to be understood that the impeller shroud treatment as will be described herein can be applicable to any centrifugal compressor of an aero gas turbine engine.

Figure 2:
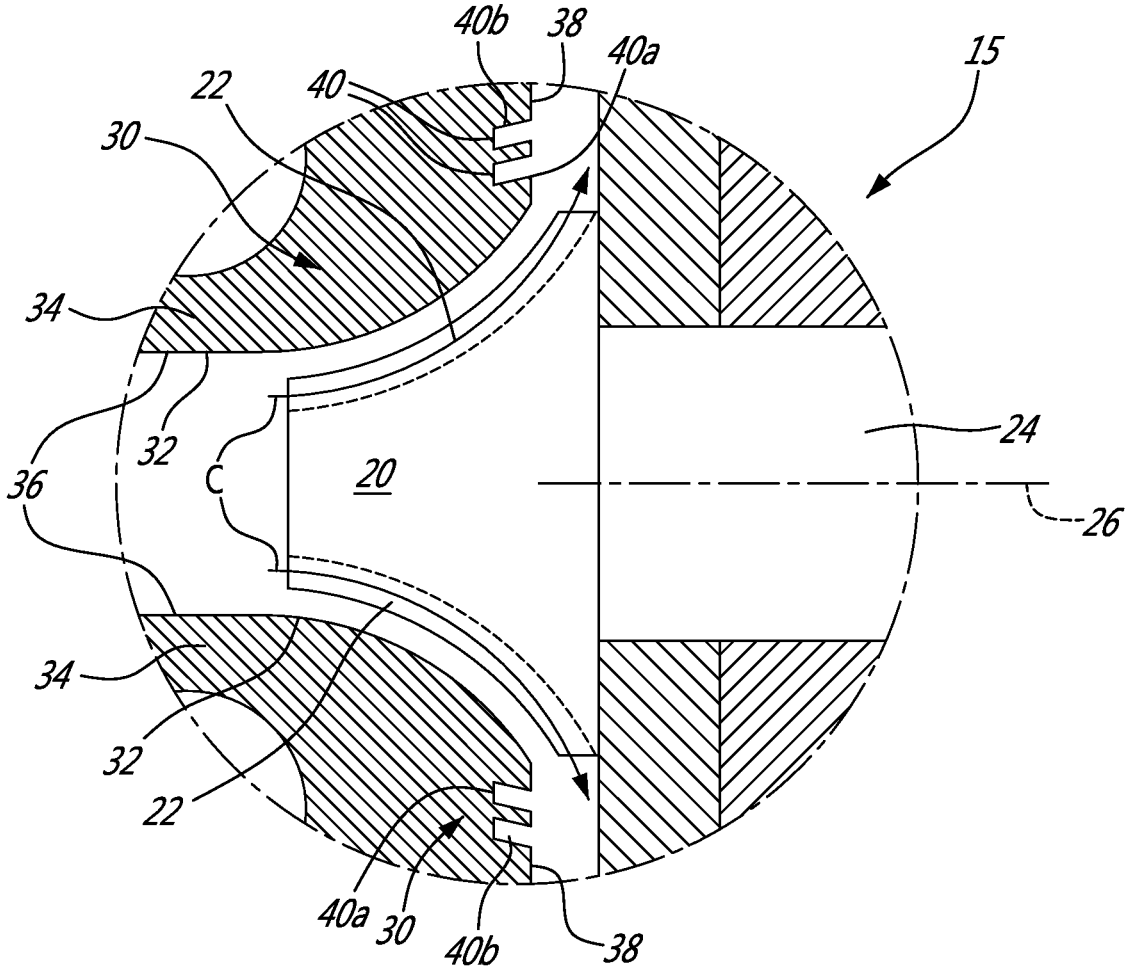
FIG. 2 is a partially-sectioned view of a centrifugal compressor of such a gas turbine engine, according to an embodiment of the present disclosure.

FIG. 2 shows a centrifugal compressor 15 (or simply "compressor" 15) of the present disclosure in partial cross-section. The compressor 15 axially receives a compressible fluid, increases the pressure of the compressible fluid, and conveys it in a substantially radial direction. The working or compressible fluid can be any fluid which can experience significant variations in density, and in most instances is air or another gas. The compressor 15 comprises at least: an impeller 20, which increases the pressure of the compressible fluid before conveying it downstream; and a surrounding impeller shroud 30, which houses the impeller 20 and provides structure to the compressor 15. Both will now be discussed in greater detail.

The impeller 20 of the compressor 15 can be any device which can rotate about a central axis so as to increase the pressure of the compressible fluid. The impeller 20 has multiple impeller vanes 22, and is mounted to a shaft 24 which rotates, along with the impeller 20, about a shaft axis 26.

The centrifugal compressor 15 also has an impeller shroud 30. The impeller shroud 30 (or simply "shroud 30") houses or encloses the impeller 20, thereby forming a substantially closed system whereby the compressible fluid enters the shroud 30, is processed, and exits the shroud 30.

The shroud 30 has a shroud body 34, which makes up the corpus of the shroud 30 and provides it with its structure and its ability to resist the loads generated by the compressor 15 when in operation. The shroud 30 also has a shroud surface 32, which is the face of the shroud 30 that is exposed to the compressible fluid, and which surrounds the impeller vanes 22. The shroud surface 32 is radially spaced apart from the impeller vanes, thereby defining a gap therebetween. This gap extends along the length of the shroud surface 32. The shroud surface 32 has a curved profile, which may match the profile of the impeller vanes 22, and which extends between an inducer portion 36 and an exducer portion 38 of the shroud surface 32. Both of these will now be discussed in greater detail.

Figure 2A:
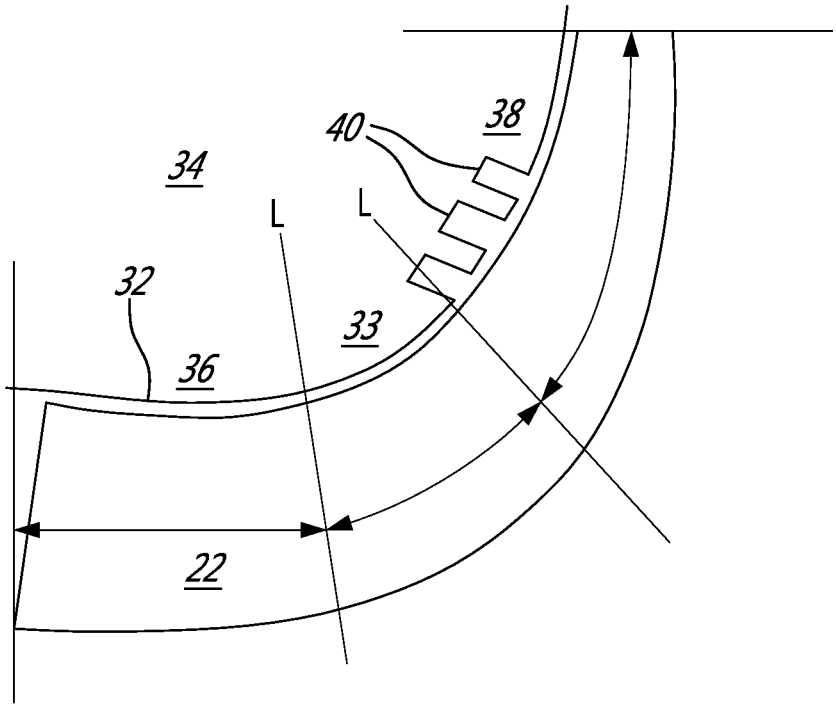
FIG. 2A is a cross-sectional view of portions of an impeller shroud surface of a centrifugal compressor such as the one shown in FIG. 2.

Referring to FIG. 2A, the location and relative size of the inducer portion 36 and the exducer portion 38 on the shroud surface 32 can vary for different centrifugal compressors 15. For certain compressors 15, the location of the inducer portion 36 and the exducer portion 38 is given in relation to a bend portion 33, or "knee", of the shroud surface 32. The bend portion 33 can be defined by a bend length, which begins at a point where the substantially axial compressible fluid starts to curve or bend, and ends at a point where the compressible fluid first begins to flow in a substantially radial direction. The bend portion 33 is demarcated in FIG. 2A by lines L, which extend in a direction normal to the shroud surface 32 at the location where the flow transitions from an axial direction, and where it transitions to a substantially radial direction. The inducer portion 36 can be any part of the shroud surface 32 which is upstream of the bend portion 33, and the exducer portion 38 can be any part of the shroud surface 32 which is downstream of the bend portion 33.

For the compressor 15 shown in FIG. 2, the inducer portion 36 corresponds to the part of the shroud surface 32 in proximity to the inlet of the impeller 20. The inducer portion 36 in this embodiment is generally a straight-line segment which is parallel to the shaft axis 26, and corresponds to the portion of the shroud 30 that receives the compressible fluid. Inducer portions 36 having other configurations are also within the scope of the present disclosure.

For the compressor 15 shown in FIG. 2, the exducer portion 38 corresponds to the part of the shroud surface 32 in proximity to the exit of the impeller 20. As shown in the embodiment of FIG. 2, the exducer portion 38 is a substantially straight-line segment extending from the end of the curve of the shroud surface 32. The exducer portion 38 extends radially with respect to the shaft axis 26, and away therefrom. It will be appreciated that the exducer portion 38 is not limited to this configuration. For example, and as shown in FIG. 2A, the exducer portion 38 can be a curved-line segment extending from the end of the bend portion 33 of the shroud surface 32. The exducer portion 38 helps to convey the compressible fluid downstream from the exit of the impeller 20, such as towards a diffuser system.

Returning to FIG. 2, the movement of the compressible fluid through the compressor 15 can be described as follows. During operation of the compressor 15, the compressible fluid is conveyed through impeller 20 and is bounded by the shroud surface 32 of the shroud 30, along a fluid flow path C. The fluid flow path C begins in the shroud 30 at the inducer portion 36 and extends toward or through the exducer portion 38. The fluid flow path C is located between the exterior faces of the impeller vanes 22 and the shroud surface 32. As such, the fluid flow path C follows the contour of the shroud surface 32. The rotation of the impeller 20 causes the compressible fluid to be drawn axially into the inducer portion 36, and further causes the compressible fluid to change direction along the fluid flow path C such that the compressible fluid is conveyed radially through the exducer portion 38.

Figure 3:
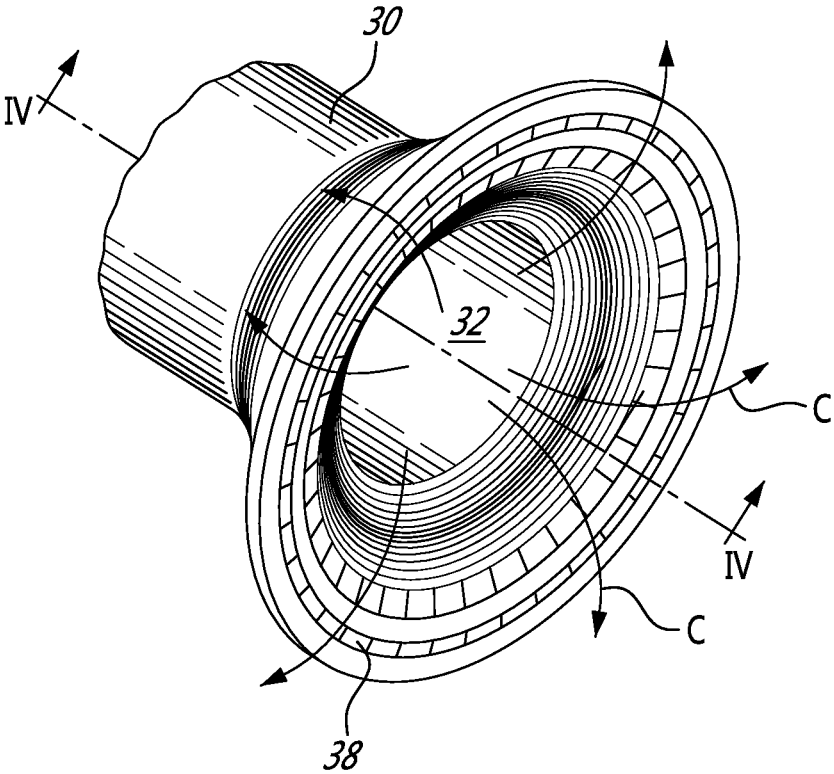
FIG. 3 is a perspective view of an impeller shroud for the centrifugal compressor of FIG. 2.

The shroud 30 also has one or more circumferentially extending grooves 40 located within the exducer portion 38 of the shroud, examples of which are shown in FIGS. 2 to 3. The term "circumferential" refers to the direction and/or orientation of the grooves 40 in that they extend along either the entire length, or just a section, of the annular shroud surface 32. Each groove 40 extends into the shroud body 34 from the shroud surface 32, thereby forming a depression or cavity extending into the shroud body 34. While a single circumferentially extending groove 40 may be provided in the exducer portion 38 of the shroud 30, when two or more such grooves 40 are provided, as depicted in FIGS. 2-3, the circumferentially extending grooves 40 may be substantially concentric relative to each other and thus form substantially concentric rings in the shroud surface 32. These groove rings 40 need not be annularly uninterrupted, however, and therefore may be comprised of a number of arcuate groove segments which together make up each of the grooves 40. The grooves 40 are located within the exducer portion 38. The term "within" when used to describe the location of the grooves 40 refers to the disposition of each groove 40, in that each groove 40 is located at a point on the substantially straight or radial line segment extending from the end of the bend portion 33 of the shroud surface 32. Many other possible locations of the grooves 40 within the exducer portion 38 fall within the scope of the present disclosure.

The number of grooves 40 in the shroud 30 can vary. In most embodiments, the number of grooves 40 will not exceed six. In some embodiments, an example of which is provided in FIG. 2, the shroud 30 can have a first circumferential groove 40*a* and a second circumferential groove 40*b*. In addition to the number of grooves 40, their location relative to one another can also vary. For example, the second groove 40*b* can be disposed within the exducer portion 38 downstream of the first groove 40*a* in the direction of the fluid flow path C. The spacing of the first and second grooves 40*a*,40*b* from each other along the shroud surface can vary, and in some instances, can depend on the width of the grooves 40 themselves.

Figure 4:
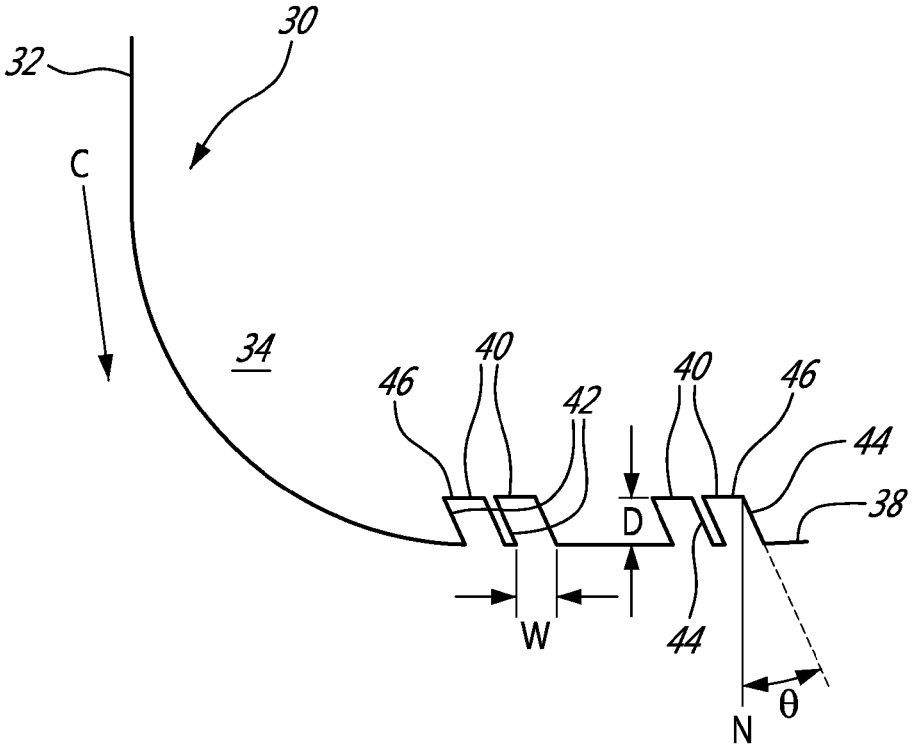
FIG. 4 is a partial cross-sectional view of an impeller shroud of the centrifugal compressor of FIG. 2, taken through the line IV-IV of FIG. 3, showing a circumferential groove configuration.
Figure 5:
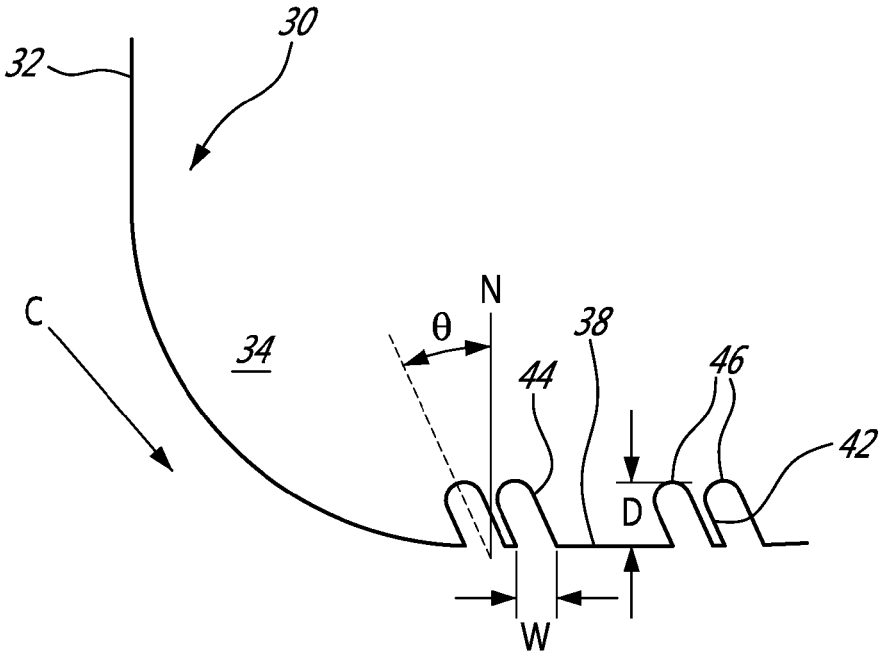
FIG. 5 is a partial cross-sectional view of an impeller shroud in accordance with an alternate embodiment of the present disclosure, showing an alternate circumferential groove configuration.

Referring now to FIGS. 4 and 5, each groove 40 has opposed wall segments, shown as a first wall segment 42 extending from the shroud surface 32 into the shroud body 34, and a second wall segment 44 extending from the shroud surface 32 into the shroud body 34. The first and second wall segments 42,44 of each groove 40 can be substantially flat or level lines defining the extent or width W of each groove 40. The relationship of the first wall segment 42 with the second wall segment 44 is one that is "opposed and spaced apart", meaning that the first and second wall segments 42,44 face one another across a gap, and define the opposed sides of each groove 40.

The first and second wall segments 42,44 of each groove 40 are linked together by a groove bottom segment 46. In most embodiments, the groove bottom segment 46 forms the bottom or end of each groove 40, and defines its width W. The groove bottom segment 46 can take many different profiles. For example, in the embodiment shown in FIG. 4, the groove bottom segment 46 is substantially flat. In another embodiment, an example of which is shown in FIG. 5, the groove bottom segment 46 is substantially curvilinear or rounded. The compressible fluid first enters the grooves 40, reverses direction, and is ejected from the grooves 40. Such a curved groove bottom segment 46 may facilitate this reversal of direction and ejection of the compressible fluid from groove 40. It can thus be appreciated that many possible shapes and configurations of the groove bottom segment 46 are possible.

In light of the preceding, it can be appreciated that the first wall, second wall, and groove bottom segments 42,44,46 define the contour and shape of each groove 40. The first and second wall segments 42,44 extend into the shroud body 34 to a groove depth D, and are spaced apart from one another by a groove width W. Many possible groove depth D and groove width W values are possible, and may depend upon numerous factors such as the desired surge margin of the engine 10 and the efficiency of the compressor 15. For example, the greater the groove depth D, the higher likelihood that the surge margin will increase, but at the expense of compressor efficiency. Similarly, a greater groove width W may improve communication between the flow of the compressible fluid in the groove 40 and the fluid flow path C, but may also affect the performance of the compressor 15. It can thus be appreciated that selecting the values of groove depth D and groove width W can involve a trade-off between different engine parameters.

Still referring to FIGS. 4 and 5, both of the first and second wall segments 42,44 are inclined at a nonzero groove angle θ with respect to a normal N of the shroud surface 32. The term "both" encompasses the groove angle θ of the first wall segment 42 and the second wall segment 44, in that these two segments 42,44 are each inclined at the same nonzero groove angle θ with respect to the normal N. The expression "nonzero" refers to the value of the groove angle θ. This value can be any number other than zero, meaning that the first and second wall segments 42,44 are not substantially normal to the shroud surface 32.

The groove angle θ can be measured in different ways, provided that it is measured relative to the normal N at that point on the shroud surface 32. This is more easily understood by comparing the groove angles θ shown in FIGS. 4 and 5. As can be seen, the groove angles θ in both figures may have the same absolute value, but their real values may differ. The normal N of the shroud surface 32 at any given point along the shroud surface 32 is determined by taking the tangent to the shroud surface 32 at that point, and drawing a line perpendicularly to the tangent at that point.

Such an inclination of the first and second wall segments 42,44 may advantageously help better direct the compressible fluid downstream and away from the exducer of the impeller 20. This may result in less disruption to the main flow of the compressible fluid, may also lower the losses caused by flow mixing, and may increase overall efficiency. Furthermore, the use of inclined first and second wall segments 42,44 may reduce the number of grooves 40 which might be needed for a given shroud 30, thereby further advantageously improving machining and manufacturing costs.

The nonzero groove angle θ at which the grooves 40 are inclined allows for a more uniform reintroduction of the compressible fluid into the fluid flow path C as the compressible fluid is ejected from the groove 40. By providing such a suitable groove angle θ to the extent permitted by machining capacity, the compressible fluid is able to re-enter the fluid flow path C along a direction that is substantially parallel to the fluid flow path C. In contrast, conventional grooves having wall segments inclined normal to the surface of the impeller shroud reintroduce the compressible fluid perpendicularly to the flow path, and can thus interfere with the flow of the compressible fluid.

The absolute value of the groove angle θ of the first and second wall segments 42, 44 can vary. In some embodiments, the groove angle θ can be chosen amongst a range of possible absolute values. In one specific embodiment, the groove angle θ is 45°.

The first and second wall segments 42,44 are inclined in a direction against, or opposite, the fluid flow path C. Such an orientation of the first and second wall segments 42,44 allows the compressible fluid to eject from the groove 40 in a direction aligned with the direction of the fluid flow path C.

Figure 6:
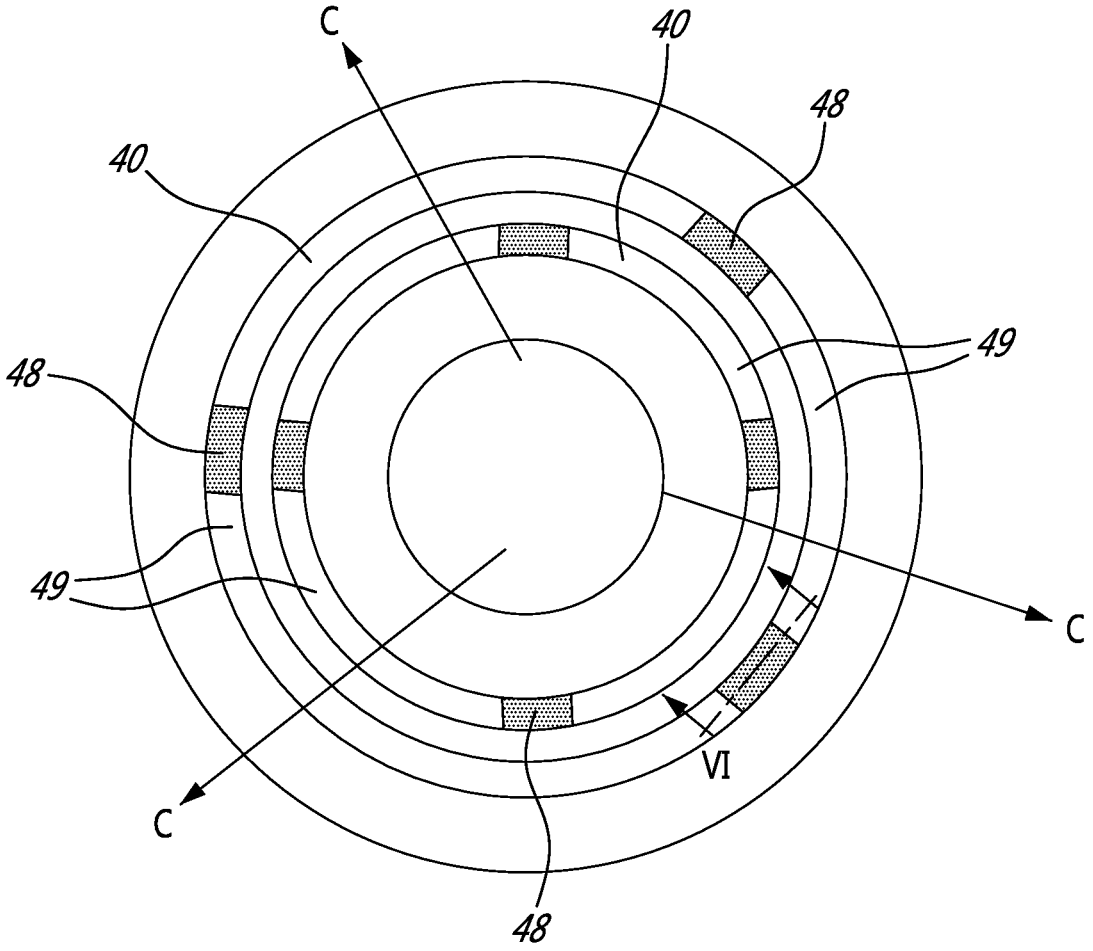
FIG. 6 is an end view of an impeller shroud for a centrifugal compressor in accordance with another embodiment of the present disclosure, the impeller shroud having at least partially circumferentially extending grooves and groove partitions.
Figure 6A:
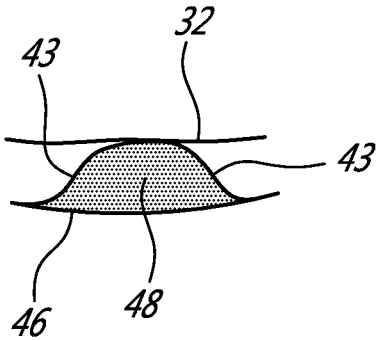
FIG. 6A is a cross-sectional view of one of the groove partitions shown in FIG. 6, taken along the line VI-VI.

In in the exemplary embodiments of FIGS. 6 and 6A, each of the grooves 40 may be circumferentially discontinuous, and as such can have one or more groove partitions 48. Each groove partition 48 can be a block or other similar obstruction which is located within the groove 40 in question, thereby occupying the width W and some or all of the depth D of the groove 40.

Certain prior art shroud indentations trap a significant portion of the gas flow within the circumferential indentations, forcing them to circulate within the indentations. This prevents the gas from exiting the shroud, and can thus adversely affect the overall operation of the compressor.

The optional groove partitions 48 can block the flow of the compressible fluid inside the same groove 40, thus preventing the compressible fluid from flowing inside the groove 40 from one side of each groove partition 48 to its other side. In so doing, each groove partition 48 may advantageously force the compressible fluid to exit the groove 40 faster than it might otherwise have done so, thus helping to overcome some of the problems described above. The groove partitions 48 may also advantageously reduce the temperature rise which can occur in the grooves 40 when the compressible fluid circulates in the grooves 40.

Each groove partition 48 can take different shapes and configurations. In one possible embodiment, one or more groove partitions 48 can consist of a block extending across the width W of the groove 40, and extending from the groove bottom segment 46 so as to arrive substantially flush with the shroud surface 32. In such a configuration, the groove partition 48 advantageously does not significantly interfere with the fluid properties of the shroud surface 32. In another possible embodiment, one or more groove partitions 48 can consist of a block extending across the width W of the groove 40. Such a groove partition 48 can vary in height, such that it begins within the groove 30 at a height lower than the shroud surface 32, and rises from the inner part of the groove 40 (i.e. the part closest to the impeller 20) to arrive flush with the shroud surface 32 at the outer part of the groove 40 (i.e. the part furthest from the impeller 20).

In yet another possible embodiment, an example of which is provided in FIG. 6A, each groove partition 48 can have one or two flow exit ramps 43 disposed on opposed circumferential ends of the groove partition 48. Each flow exit ramp 43 can help to guide the circulating compressible fluid out of the groove 40 in which the groove partition 48 is located, thus helping to prevent the recirculation of the compressible fluid within the groove 40. The configuration of the flow exit ramps 43 can vary. For example, the flow exit ramp 43 can be defined by an inclined flat plane which extends across the width W of the groove, and which rises at an incline from the groove bottom segment 46 until the shroud surface 32. Alternatively, the flow exit ramp 43 can be defined by an inclined curved plane, similar to a "ski jump", which extends across the width W of the groove, and which rises along a curved profile from the groove bottom segment 46 until the shroud surface 32.

The choice between the possible shapes and configurations of the groove partitions 48 can be determined based upon consideration of the following non-exhaustive list of factors: their effect on the performance of the compressor 15, their difficulty to machine or install in the grooves 40, and the intended use of the compressor 15.

The groove partitions 48 divide the grooves 40 in which they are located into groove slots 49. The number and angular width of each of the groove slots 49 can vary depending on the number and location of the groove partitions 48 for a particular groove. In some embodiments, the groove partitions 48 of a given groove 40 are disposed at regular or irregular angular intervals from an adjacent groove partition 48. The angular interval can vary or remain constant for a single groove 40, and between adjacent grooves 40.

Figure 7A:
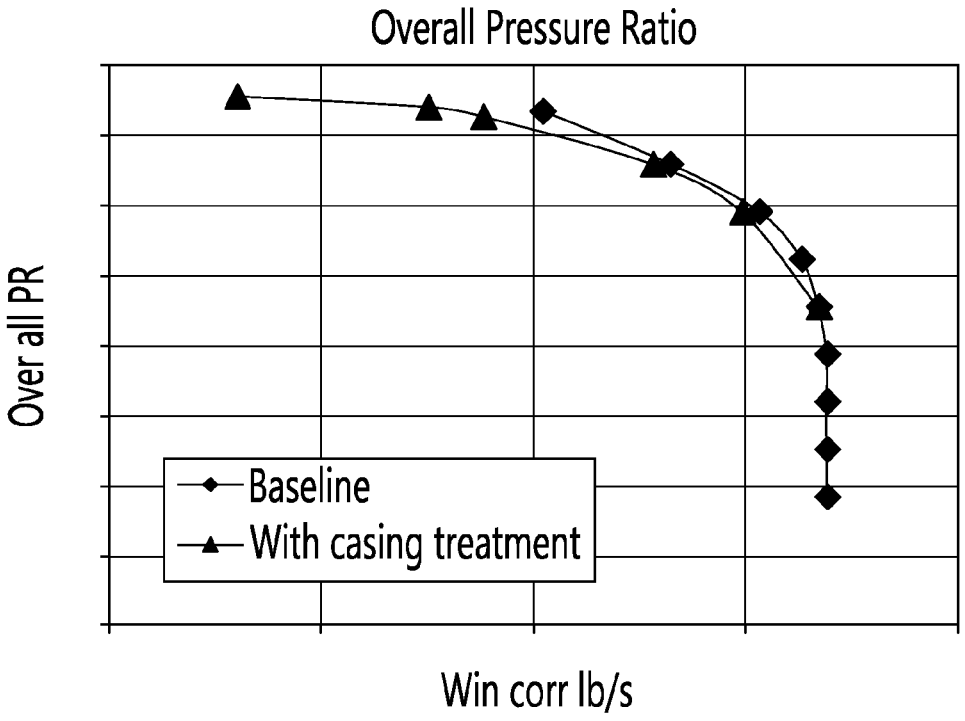
FIGS. 7*a*-7*b* show graphs comparing the overall pressure ratio and the overall efficiency of the compressor for a baseline impeller shroud versus a treated impeller shroud.
Figure 7B:
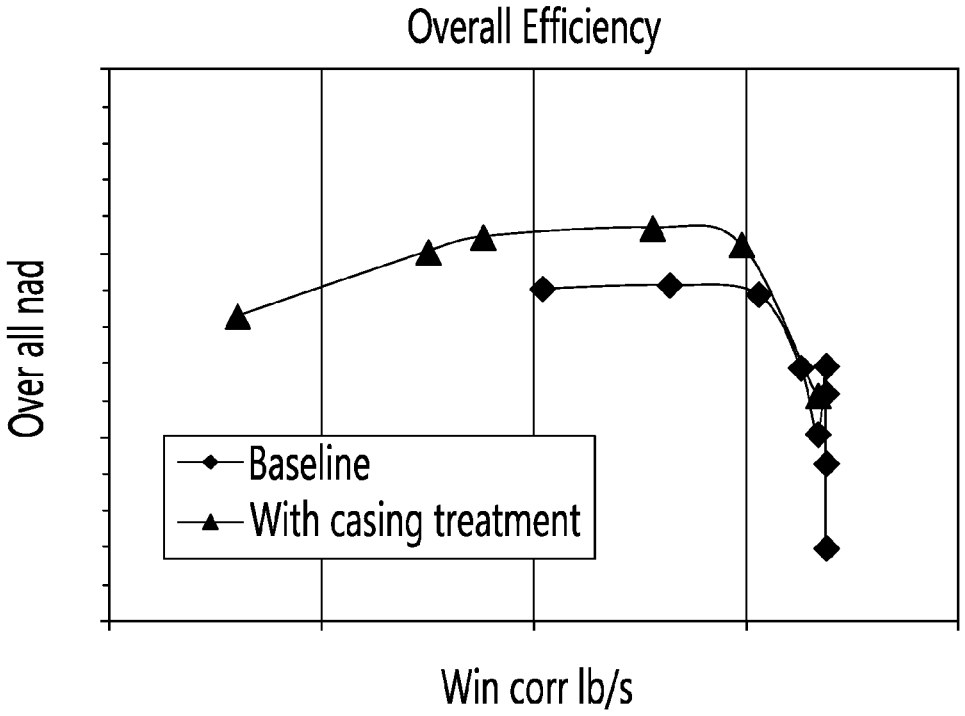
Figure 8A:
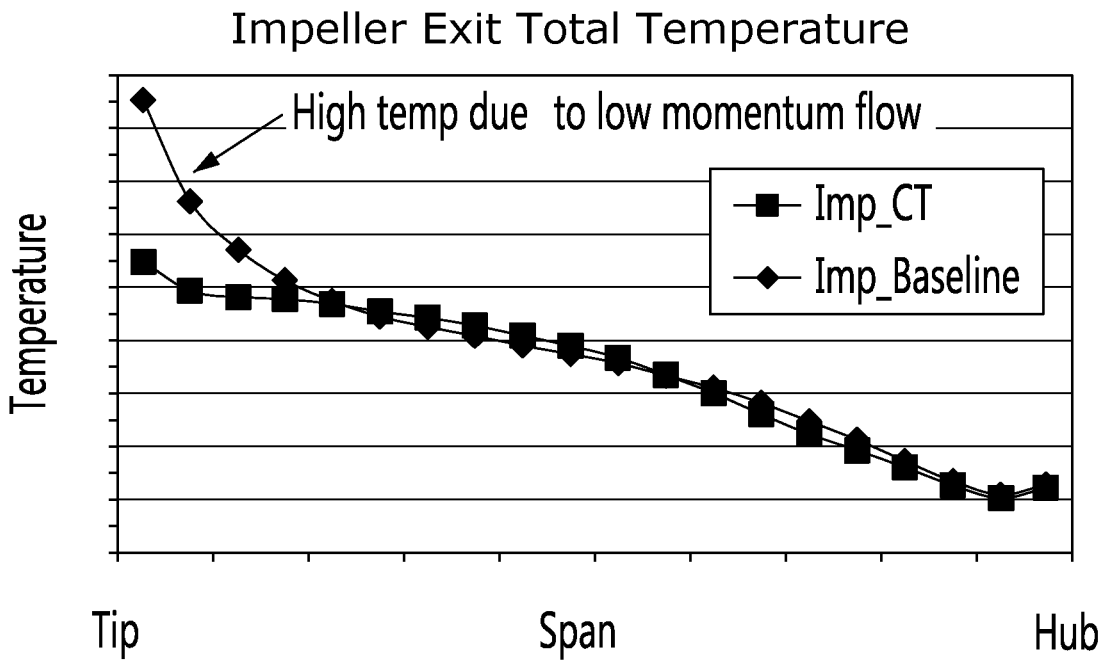
FIGS. 8*a*-8*b* show graphs comparing the impeller exit total temperature and the impeller exit velocity for a baseline impeller shroud versus a treated impeller shroud.
Figure 8B:
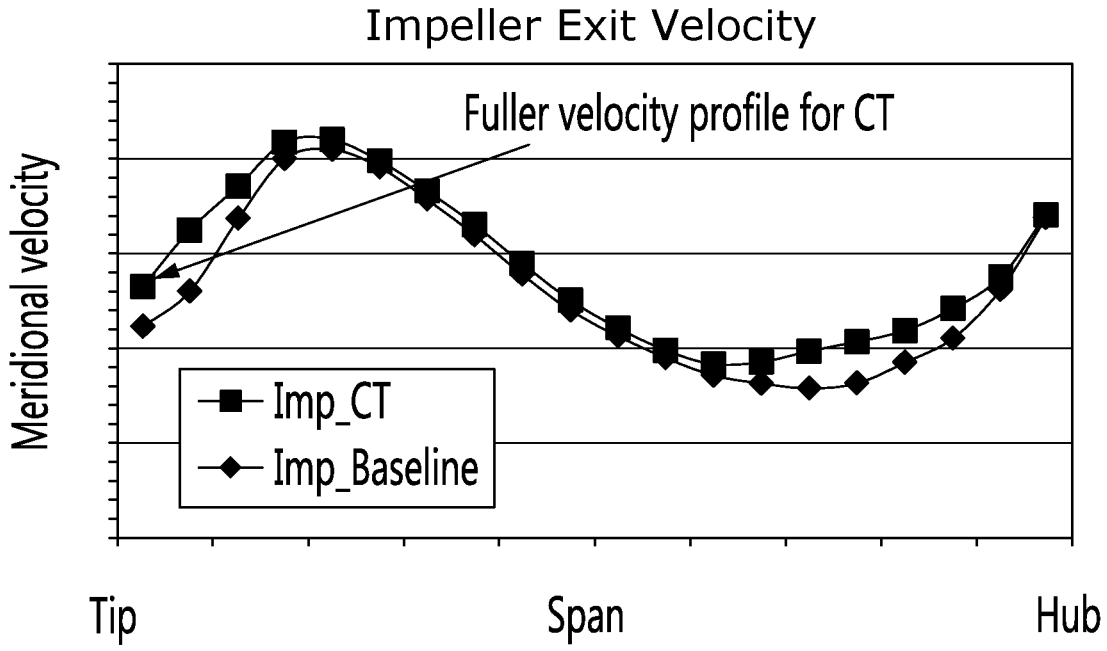

FIGS. 7*a*-7*b* and 8*a*-8*b* show graphs of certain parameters of a compressor for a shroud 30 without circumferential grooves 40 (referred to in FIGS. 7 and 8 as the "Baseline") versus a shroud 30 with the circumferential grooves 40 (referred to in FIGS. 7 and 8 as "casing treatment" or "CT"). The values and trends shown in the graphs are provided for the sole purposes of comparing and contrasting the two types of shrouds 30. The curves of these graphs may vary depending on numerous factors, and thus, so may the extent by which reliable comparisons can be drawn. It will be appreciated that the performance of the compressor 15 is not limited to, or defined by, the curves shown.

The graph of FIG. 7*a* plots the overall pressure ratio as a function of the mass flow rate of the compressible fluid for a compressor having a "baseline" shroud, versus the compressor 15 having the "treated" shroud 30. As can be seen, the curves for both types of shrouds are substantially similar, with the "treated" shroud 30 showing improved surge margin over the "baseline" shroud.

The graph of FIG. 7*b* plots the overall efficiency of the compressor 15 as a function of the mass flow rate of the compressible fluid for a compressor having a "baseline" shroud, versus the compressor 15 having the "treated" shroud 30. As can be seen, the overall efficiency of the compressor 15 having the "treated" shroud 30 can be greater for most mass flow rates when compared to the compressor having the "baseline" shroud, which is an indication of improved compressor 15 performance.

Advantageously, and in contrast with certain prior art treated compressor shrouds, there does not appear to be a trade-off between compressor 15 performance (as represented by pressure ratio and surge margin) and overall compressor efficiency for compressors 15 having the shroud 30 with circumferential grooves 40 described above.

The graph of FIG. 8*a* plots the total temperature of the compressible fluid at the exit of an impeller as a function of the span of the impeller. Two curves are produced. The "Imp_Baseline" curve represents the data for a compressor having a "baseline" shroud, and the other "Imp_CT" curve represents the data for the compressor 15 having the "treated" shroud 30. As can be seen, the "treated" shroud 30 may advantageously generate lower total temperatures near the tip of the impeller, and substantially the same total temperatures as the "baseline" shroud for other locations along the impeller.

The graph of FIG. 8*b* plots the velocity of the compressible fluid at the exit of an impeller as a function of the span of the impeller. Two curves are produced. The "Imp_Baseline" curve represents the data for a compressor having a "baseline" shroud, and the other "Imp_CT" curve represents the data for the compressor 15 having the "treated" shroud 30. As can be seen, the "treated" shroud 30 may advantageously have a fuller velocity profile when compared to that of the "baseline" shroud along all locations of the impeller.

Figure 9:
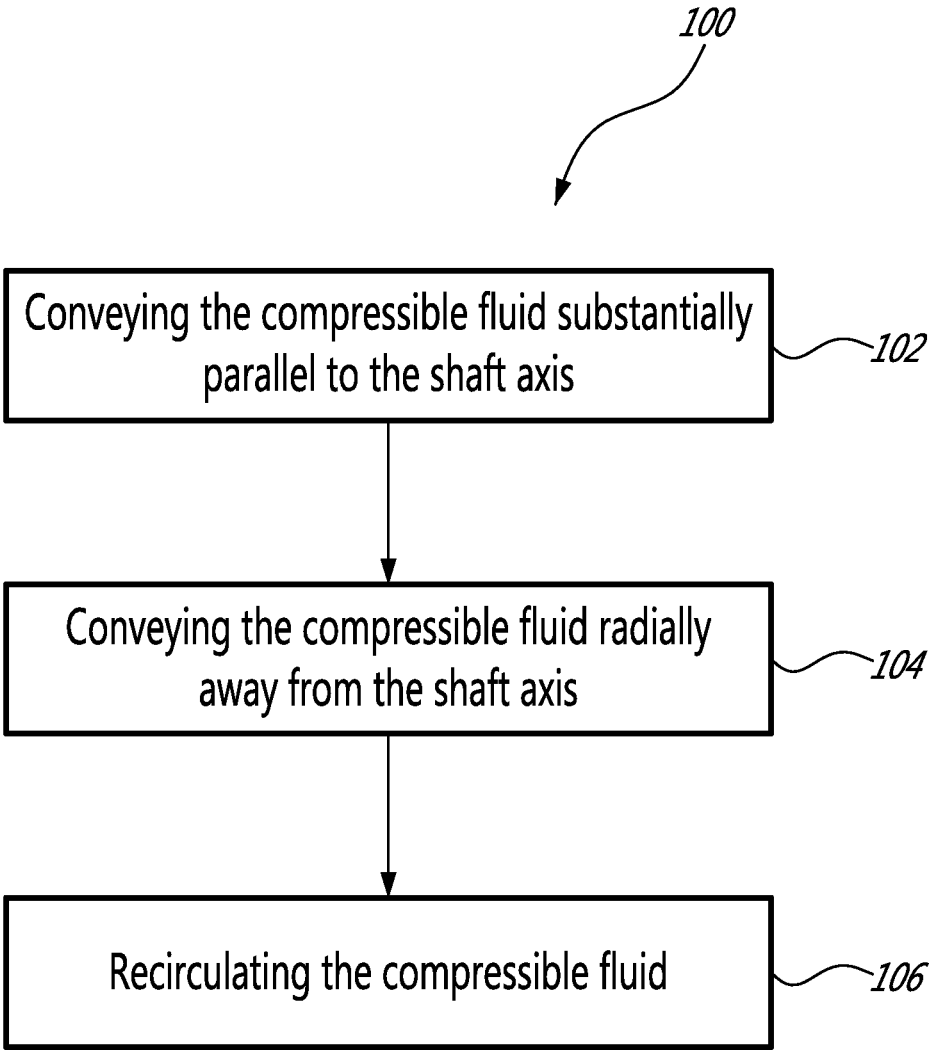
FIG. 9 is a block diagram of a method of reducing flow blockage of a compressible fluid, according to another embodiment.

A method of reducing flow blockage of a compressible fluid at an exit of an impeller of a centrifugal compressor is also provided. Referring to FIG. 9, the centrifugal compressor of the method 100 disclosed herein is similar to the compressor 15 described above.

Flow blockage is a phenomenon observed in many compressors. It is known that the flow of the compressible fluid at the exit of the impeller is highly complex. The pressure of the compressible fluid is raised rapidly after the impeller inlet, starting at the impeller bend area. The combination of the rapid rise in pressure and the relatively high curvature of the shroud surface can cause a relatively high adverse pressure gradient to develop as the compressible fluid negotiates the curved shroud surface. This results in a build-up of the boundary layer due to the deceleration of the compressible fluid, and leads to increased flow blockage. This flow blockage can reduce the pressure gains achieved by the compressor and cause flow separation.

The method 100 involves conveying the compressible fluid substantially parallel to the shaft axis along the fluid flow path and through the inducer portion, identified in FIG. 9 with the reference number 102. This can occur, for example, when the impeller is rotating, thereby drawing the compressible fluid through the inducer portion.

The method 100 also involves conveying the compressible fluid radially away from the shaft axis along the fluid flow path and through the exducer portion, identified in FIG. 9 with the reference number 104. This can occur, for example, when the pressurized compressible fluid leaves the exit of the impeller.

The method 100 also involves recirculating the compressible fluid between the fluid flow path and the one or more circumferential grooves described above, identified in FIG. 9 with the reference number 106. The recirculation of the compressible fluid 106 can involve the compressible fluid being injected or inserted into the grooves. It can also involve removing the compressible fluid from within the grooves. The recirculation of the compressible fluid in 106 may help to alleviate the flow blockage associated with conventional exits of impellers by breaking up relatively large flow vortices into smaller flow vortices. These smaller flow vortices may have less permanence and be easier to dissipate. They may also be confined closer to the grooves, which may improve flow conditions to components downstream of the compressor, such as a diffuser system.

The above description is meant to be exemplary only, and one skilled in the art will recognize that changes may be made to the embodiments described without departing from the scope of the invention disclosed. Such modifications are intended to fall within the appended claims.

The invention claimed is:

1. A centrifugal compressor, comprising:

an impeller mounted to a shaft and rotatable about a shaft axis, the impeller having a plurality of impeller vanes; and an impeller shroud enclosing the impeller, the impeller shroud having a shroud surface having inducer and exducer portions, the shroud surface surrounding and radially spaced apart from the impeller vanes to define a fluid flow path between the shroud surface and the impeller vanes, at least one groove defined by opposed wall segments which extend into the shroud surface within the exducer portion, the wall segments inclined at a nonzero angle relative to a normal of the shroud surface at the at least one groove in a direction opposite to the fluid flow path along the shroud surface, the opposed wall segments being linked by a groove bottom segment.

2. The centrifugal compressor as defined in claim 1, wherein the nonzero angle of the wall segments is the same.

3. The centrifugal compressor as defined in claim 1, wherein the at least one groove is circumferentially discontinuous.

4. The centrifugal compressor as defined in claim 3, wherein the circumferentially discontinuous groove comprises one or more groove partitions, each groove partition occupying a width and a depth of the at least one groove by extending from the shroud surface to a groove bottom segment, each groove partition being adapted to block a flow of the compressible fluid in the at least one groove from one side of said groove partition to another, the groove partitions dividing the at least one groove into a plurality of groove slots.

5. The centrifugal compressor as defined in claim 4, wherein at least one of the groove partition comprises a flow exit ramp disposed at a circumferential end of the groove partition, the flow exit ramp extending across the width of the groove and extending at an incline along the depth of the groove.

6. The centrifugal compressor as defined in claim 5, wherein the flow exit ramp has a curved profile extending from the groove bottom segment and arriving flush with the shroud surface.

7. The centrifugal compressor as defined in claim 5, wherein each of the groove partitions includes said flow exit ramp on each of two opposed ends thereof.

8. The centrifugal compressor as defined in claim 1, wherein the at least one groove comprises a first groove and a second groove spaced apart from the first groove in a direction of the fluid flow path.

9. The centrifugal compressor as defined in claim 8, wherein the first and second grooves form substantially concentric rings in the shroud surface.

10. The centrifugal compressor as defined in claim 1, wherein the at least one groove comprises a maximum of six grooves.

11. The centrifugal compressor as defined in claim 1, wherein the groove bottom segment is substantially curvilinear.

12. The centrifugal compressor as defined in claim 1, wherein the groove bottom segment is substantially planar.

13. The centrifugal compressor as defined in claim 1, wherein the nonzero angle is 45°.

14. The centrifugal compressor as defined in claim 1, wherein the at least one groove extends circumferentially about the entire shroud surface.

15. A method of improving aerodynamic performance of a centrifugal compressor by reducing flow blockage of a compressible fluid at an exit of an impeller of the centrifugal compressor, the compressor having an impeller shroud enclosing the impeller so as to define a fluid flow path between a curved shroud surface and the impeller, the fluid flow path extending between an inducer portion and an exducer portion of the shroud surface, the method comprising:

conveying the compressible fluid substantially parallel to the shaft axis along the fluid flow path through the inducer portion of the centrifugal compressor;

conveying the compressible fluid radially away from the shaft axis along the fluid flow path through the exducer portion; and recirculating the compressible fluid between the fluid flow path and at least one circumferential groove extending into a body of the shroud surface within the exducer portion, the at least one groove defined by opposed wall segments which extend into the shroud surface, the wall segments inclined at a nonzero angle relative to a normal of the shroud surface in a direction opposite to the fluid flow path along the shroud surface, the opposed wall segments being linked by a groove bottom segment.

16. The method as defined in claim 15, further comprising preventing the compressible fluid from circulating throughout the at least one groove.

17. The method as defined in claim 15, wherein recirculating the compressible fluid comprises injecting the compressible fluid into the at least one groove.

18. The method as defined in claim 17, wherein recirculating the compressible fluid further comprises reversing a direction of the injected compressible fluid and ejecting the compressible fluid from within the at least one groove.

19. The method as defined in claim 18, wherein ejecting the compressible fluid comprises ejecting the compressible fluid in a direction substantially parallel to the direction of the fluid flow path.

* * * * *